United States Patent [19]

Key

[11] Patent Number: 4,701,138

[45] Date of Patent: Oct. 20, 1987

[54] SOLDERLESS ELECTRICAL CONNECTOR

[75] Inventor: Edward H. Key, Hummelstown, Pa.

[73] Assignee: Phoenix Terminal Blocks Inc., Middletown, Pa.

[21] Appl. No.: 943,087

[22] Filed: Dec. 18, 1986

[51] Int. Cl.[4] ..... H01R 4/24

[52] U.S. Cl. ..... 439/417

[58] Field of Search ..... 339/95 R, 95 D, 97 R, 339/97 P, 98, 99 R

[56] References Cited

U.S. PATENT DOCUMENTS

| | | | |
|---|---|---|---|
| 2,627,537 | 2/1953 | Weisberg | 339/99 R |
| 3,388,370 | 6/1968 | Elm . | |
| 3,793,611 | 2/1974 | Johansson et al. . | |
| 3,793,612 | 2/1974 | Driscoll . | |
| 3,912,356 | 10/1975 | Johansson . | |
| 3,992,072 | 11/1976 | Anhalt et al. | 339/97 P |
| 4,037,905 | 7/1977 | Lucas . | |
| 4,047,784 | 9/1977 | Trank . | |
| 4,062,615 | 12/1977 | Navarro . | |
| 4,379,605 | 4/1983 | Hoffman | 339/97 P |
| 4,461,528 | 7/1984 | Durand et al. . | |
| 4,537,456 | 8/1985 | Brown et al. . | |

FOREIGN PATENT DOCUMENTS

| | | |
|---|---|---|
| 2089147 | 6/1982 | United Kingdom . |

*Primary Examiner*—Joseph H. McGlynn

[57] ABSTRACT

A solderless connector for electrically connecting an insulated wire to a metal terminal is disclosed. The connector comprises a housing for slidably receiving an applicator block that carries the insulated wire. The housing also includes a terminal and an actuating lever that is operatively connected to the guide means. Arcuate movement of the lever moves the block and wire into a receiving portion of the terminal that severs the insulation and simultaneously completes a secure electrical connection.

11 Claims, 6 Drawing Figures

SOLDERLESS ELECTRICAL CONNECTOR

BACKGROUND OF THE INVENTION

1. Field of the Invention

The invention is directed to the field of electrical devices of the type used to join conductor electrically and mechanically.

2. Description of the Prior Art

Solderless devices, or more specifically insulation displacement connectors (I.D.C.), for joining electrical conductors are well known in the prior art. Earlier devices designed to eliminate the insulation stripping operation generally forced a terminal plate having a bifurcated end portion around and through the insulation; an operation requiring considerable force and usually assisted by a tool such as a pair of pliers. These types of connector devices are disclosed in U.S. Pat. No. 3,388,370 to Elm and U.S. Pat. No. 3,793,611 to Johansson et al. These prior art devices do not provide any convenient means for disengaging a wire from the connector if it becomes necessary to remove the wire. The terminal must be pried out leaving the potential of damaging the wire, the connector and adjacent components. Other similar prior art devices are shown in U.S. Pat. Nos. 4,047,784 and 3,912,356 to Trank and Johannson respectively.

None of the prior art devices is designed to effectively utilize a broad range of wire gages because the terminal resiliency is not sufficient to accommodate large differences in conductor diameter. The present invention is configured to use a zero gap I.D.C. of the type invented by the inventor of the present invention and disclosed in United Kingdom Patent Application GB No. 2 089 147 A.

SUMMARY OF THE INVENTION

The present invention overcomes the problems and limitations of the prior art. The principle object of this invention is to provide a solderless connector that will easily and without the use of tools effect a secure and reliable electrical connection between an insulated conductor and a connector terminal without prior removal of the insulation.

A further object is to provide a device that will accommodate a wide range of wire sizes.

A still further object is to provide a device that permits quick and easy removal of a connected wire.

A still further object is to provide a completely assembled device that has no unattached or loose parts that could be misplaced or lost prior to the making of the connection.

A still further object is to provide a connector that can be stacked with similar connectors in an array to form a compact assembly that can efficiently be assembled to a printed circuit board.

These and other objects are achieved by the preferred embodiment of the present invention which comprises an insulated housing configured to slidably receive an applicator block. The block is movable within the housing by means of a lever hinged to the housing and connected to the block through a pin and slot joint. This connection is kinematically constrained to one degree of freedom in motion and is commonly designated as a scotch-yoke and effects straight live movement of the applicator block.

The block includes an aperture for receiving an insulated but unstripped wire when the block is extended upwardly to partially protrude out of the housing. A metal terminal contact having a pair of spaced apart contact fingers is fixed in the housing in a position to intersect the insulated wire when the applicator carrying the wire is moved downwardly into the housing. The placement of the terminal fingers and the wire is such that the wire aligns with and enters between the fingers as the applicator block moves into the housing. The facing edges of the fingers sever the insulation and the conductor within the insulation the fingers to separate, but due to the material's resiliency pressure is maintained against the wire to form a sound electrical connection between the wire conductor and the terminal.

Suitably located detents and strain relief means are configured to provide to promote the efficiency of the device.

Reversal of the lever motion will remove the wire from between the terminal fingers if the connection must be undone.

The entire assembly is insulated from spurious connections (except for terminal tabs extending through the housing) by the lever and a plastic cover plate over the opening in the side of the housing.

Having in mind the above and other objects that will be obvious from an understanding of the disclosure, the present invention comprises a combination and arrangement of parts illustrated to the presently preferred embodiments of the invention which are hereinafter set forth in sufficient detail to enable those persons skilled in the art to clearly understand the function, operation, construction and advantage of it when read in conjunction with the accompanying drawings.

BRIEF DESCRIPTION OF THE DRAWINGS

The invention will be described in detail, by way of example, with reference to the accompanying drawing in which.

DESCRIPTION OF THE PREFERRED EMBODIMENT

Figure 1:
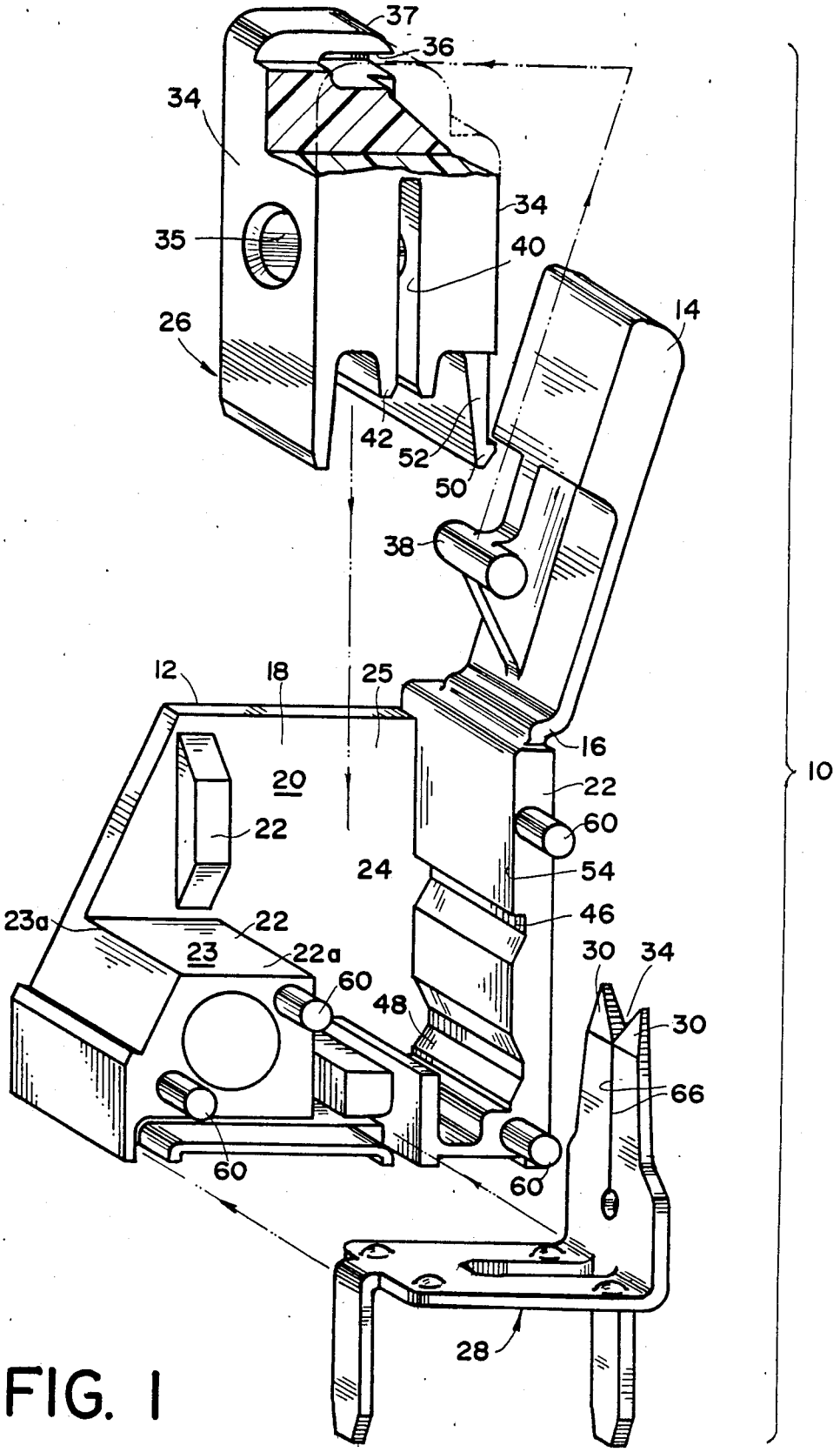
FIG. 1 is an exploded pictorial view of the connector.
Figure 2:
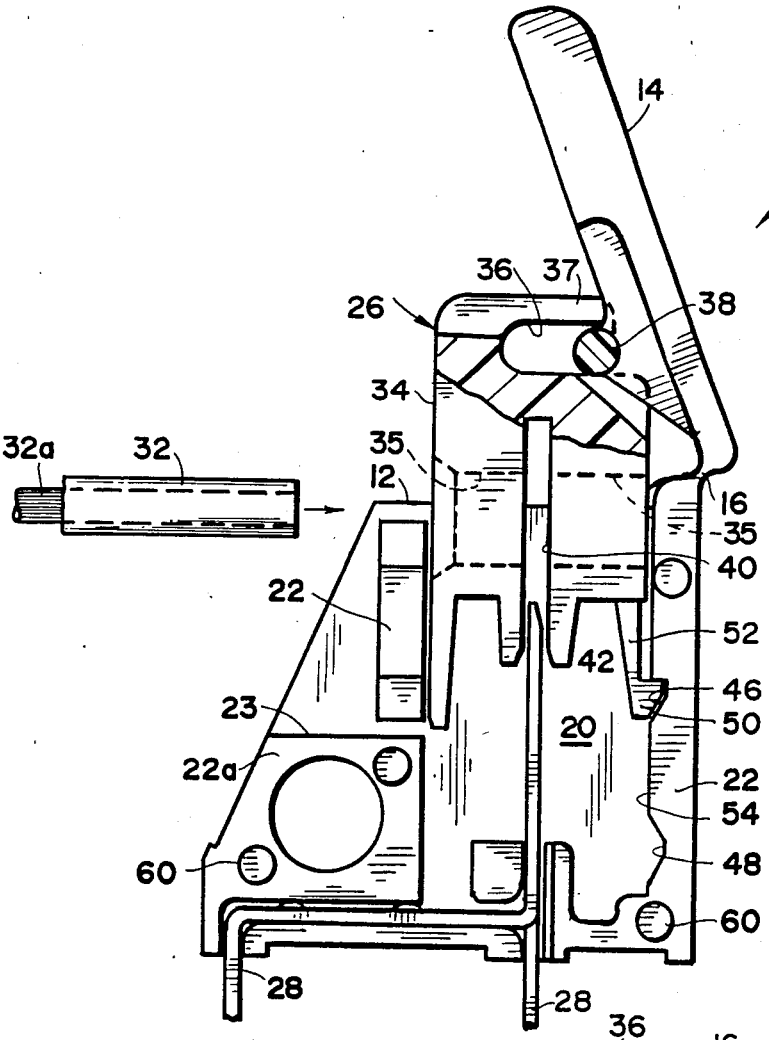
FIG. 2 is front view of the connector shown in the wire disconnecting position with the overlying cover removed.
Figure 3:
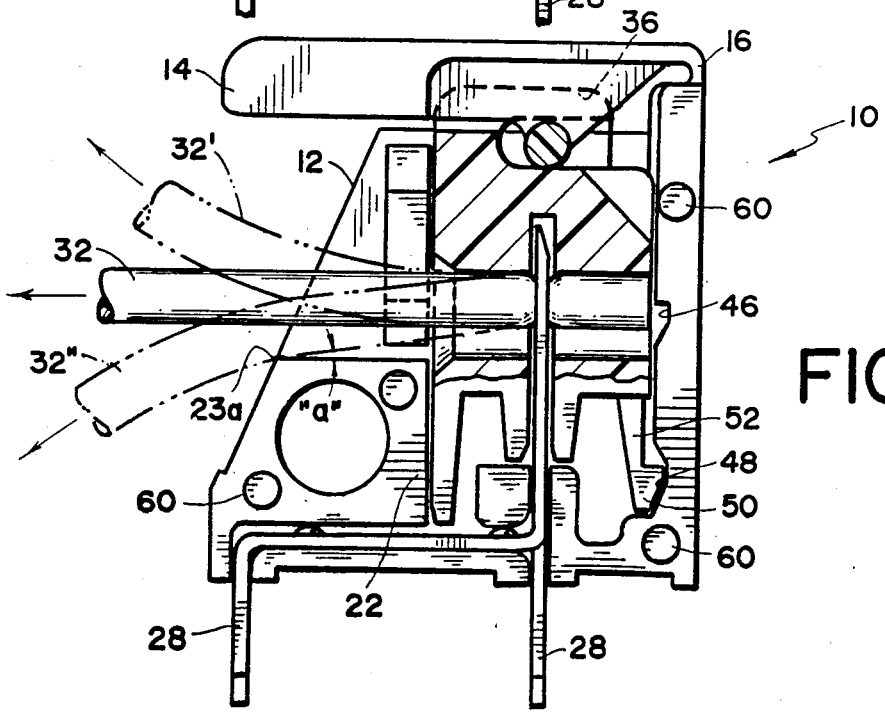
FIG. 3 is a front view of the connector shown in the wire connecting position with the overlying cover removed.

Referring to FIGS. 1–3, and in accordance with the principles of the invention a solderless or I.D.C. connector assembly 10 is shown comprising a body or housing 12 made of a heat resistant thermoplastic material with an integral lever member 14 hingedly connected to a portion 16 of the housing. The lever 14 is movable by rotation between an open position as illustrated in FIG. 2 to a closed position as illustrated in FIG. 3. The housing 12 includes an end opening 18 that is uncovered when the lever 14 is in the open position and closed by the lever 14 when it is disposed in the closed position. The housing further includes a planar back face 20 substantially flat on both sides and a plurality of side wall members 22 projecting perpendicular from the inner surface of the back face 20 and having parallel and spaced apart cooperating side edges 24 to provide a compartment 25 for guiding an applicator block 26. One side wall member 22*a* is configured to form a shelf portion 23 that will serve as a strain relief for the connected wire as will be explained subsequently.

A metal terminal 28 fabricated from 0.020" (0.5mm) thick phosphor bronze alloy having a pair of closely spaced and resilient wire engaging tines or fingers 30 disposed at one end portion of the terminal is affixed to the housing 12. The terminal 28 comprises the electrically conductive member that electrically contacts the conductor 32*a* of an insulated wire 32 to complete a solderless connection within the connector assembly 10. The fingers 30 have their end portion cut inclined to one another to form a wedge 34 that provides a lead in for the insulated wire 32 when it is carried between the fingers 30.

The wire 32 in carried into engagement with the terminal by the wire guide or applicator block 26 that slides within the housing 12. The block 26 has parallel side edges 34 that are slidably received between the cooperating surfaces 24 of the wall members 22 thus confining the block 26 to move in a straight line path within the channel formed by the back face 20 and the surfaces 24 to slide the wire 32 to a position between the fingers 30 of the terminal 28 and, upon reversal of the movement, out of engagement with the fingers to disconnect the wire 32.

To insert the insulated wire 32 in the block 26, an aperture 35 is provided that passes through the block 26 intersecting and disposed perpendicular to both side edges 34.

The translatory movement of the block 26 extends from a first position or disconnecting position shown in FIG. 2 where the block extends partially outside of the housing 22 exposing the aperture 35 for insertion of the wire 32 to a second or connecting position shown in FIG. 3 where the wire is urged between the terminal fingers 30.

Movement is imparted to the applicator block 26 by the movement of the lever 14. The operative connection of these members is through a kinematic linkage comprising an elongated slot 36 formed at the outermost end portion 37 of the applicator block 26 and extending transverse to its path of motion and a pair member or cylindrical pin 38 affixed to an intermediate portion of the lever 14. The pin 38 is slidably received in the slot 36. This connection of the block 26 and lever 14 positions the block 26 in the disconnecting position when the lever 14 is in the open postion and moves the block 26 into the connecting position as the lever 14 is rotated to the closed position.

Figure 4:
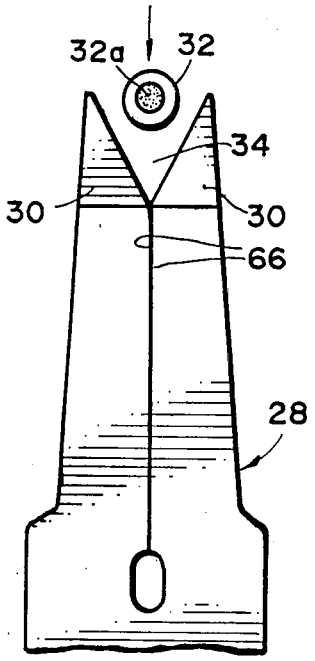
FIG. 4 is a partial view of the terminal fingers prior to insertion of the insulated wire.
Figure 5:
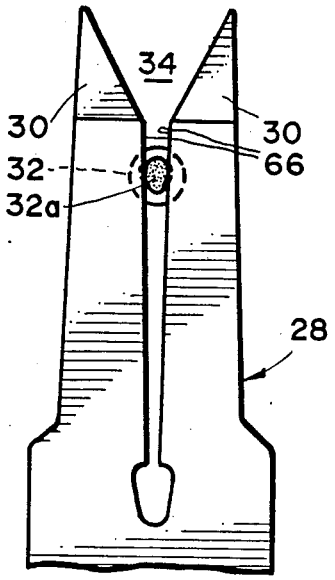
FIG. 5 is a partial view of the terminal fingers after insertion of the insulated wire.

The configuration of the applicator block 26 further includes another elongated slot 40 disposed at the innermost end position 42 and extending parallel to the path of motion of the block 26 and positioned to surround the fingers 30 of the affixed terminal 28 when the block is in the connecting position. An aperture 35 is provide in the applicator block 26 for receiving the insulated wire 32. The aperture 35 is disposed transverse to the slot 40 and intersecting said slot so that the inserted wire 32 is transported into wedge 34 between the fingers 30 and further transported in the space between the fingers when the block is positioned in the connecting position. (FIGS. 4 and 5)

The applicator block 26 is retained either in the disconnecting position or the connecting position by means of a pair of detent notches 46, 48 cooperating with a detent pawl 50. The pawl 50 is affixed to an extending leg 52 of the applicator block while the notches 46, 48 are formed in one of the side edges 54 of the wall members 22. The upper detent notch 46, corresponding with the disconnected position of the block is configured to prevent the block from exiting the opening 18 while permitting the block to be moved into the connecting position. The pawl 50 is biased into the notches 46, 48 by virtue of the resiliancy of the leg 52 which must be slightly compressed when the block 26 is installed into the housing.

Figure 6:
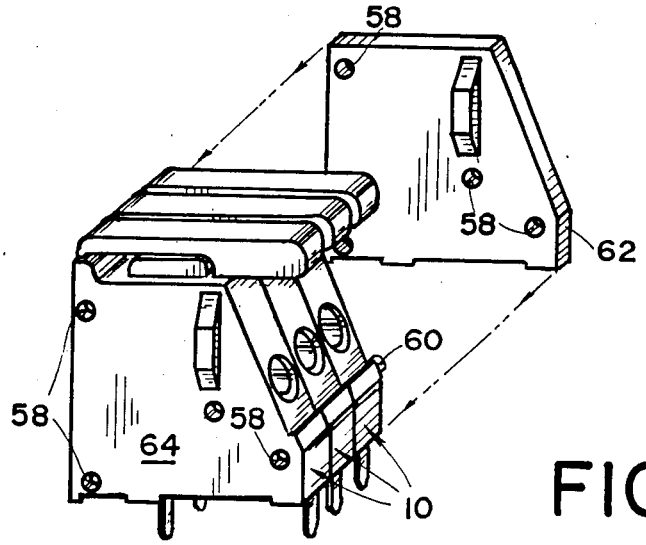
FIG. 6 is an exploded pictorial view of an array of connector assemblies and an overlying cover.

The applicator block 26 is confined in the compartment 25 in housing 18 between a planar member 56 overlying the side walls 22 and positioned parallel to the rear face 20 of the housing 18. The planar member includes a plurality of holes 58 each cooperating with a pinning member 60 extending from the side wall members 22 and closely received in the holes 58 to make the planar member releasably retainable against the side walls. The planar member can be configured as a cover plate 62 or be formed as part of the rear face 64 of another body member 18. In this way, a plurality of connectors can be stacked in a parallel array to form a compact assembly as shown in FIG. 6.

In use, one rotates the lever 14 to the open position thereby raising the applicator block 26 to its disconnecting position wherein it extends partially outside of the housing 12. The detent pawl 50 is now seated in the upper detent notch 46. In this position, the wire receiving aperture 35 is easily accessible and an insulated wire 32 is inserted to the full depth of the aperture. Solid or stranded wires varying from 16 to 26 gage and having insulation not exceeding the aperture 35 diameter (approximately 0.110 inches or 2.8 millimeters) can be accommodated. The lever 14 is then rotated to the closed position driving the block to the connecting position by virtue of the pin 38 and slot 36 operative means. In moving to this position, the wire 32 enters the wedge 34 configured between the terminal fingers 30 and is forced therebetween. The opposing edges 66 of the fingers first sever the insulation and then, because of the resiliency of the material, compress the conductor 32*a* to complete a reliable solderless I.D.C. connection between the wire and the terminal as shown in FIGS. 4 and 5. As the connection is being completed, the detent pawl 50 snaps into the lower detent groove 48 thereby retaining the connector 10 in the connecting position.

In this connected position, not only is the conductor 32*a* within the wire securely held between the fingers 30 of terminal 28, the compression of the conductor 32*a* as shown in FIG. 5 resists a straight axial strain or pull on the wire 32 as indicated in FIG. 3. Strain relief must also be afforded if the wire is pulled in an upward direction (wire 32') or a downward direction (wire 32"). In either of these cases the conductor must not rise out of nor move further between the fingers 30 than the position it assumed upon action of the actuator block when making the connection in the I.D.C.

If an upward pull is applied, the portion of the wire within the aperture 35 remains horizontal since this portion is already bearing against the upper surface of the aperture. Thereby, the effect of an upward pull on wire 32' is translated into an axial pull which as stated above can be resisted by the terminal.

If the pull on the wire 32" is downward, the wire assumes a small angle "a" as shown in FIG. 3. The angle "a" is defined by the maximum angle the wire could assume when the stripped portion is between the fingers 30 and an intermediate portion bears against a corner 23*a* of the shelf 23. The magnitude of the angle is determined by the wire diameter over the insulation, the size of the aperture and the configuration of the housing and block. This angle would not normally exceed 10 degrees. The component of the pulling force directed downward at the terminal is the pulling force times the sine of 10 degrees (sine 10 degrees=0.173) therefore only 17.3% of the force is reflected downward which would not overcome the friction forces between conductor and terminal. In this way, a downward pull will absorbed much as is a straight axial pull.

If it becomes necessary to remove the wire from the connector, the procedure is reversed. The lever 14 is rotated to the open position disengaging the pawl 50 from the lower detent notch 48 and raising the applicator block 26 to the disconnecting position, thereby removing the wire from between the terminal fingers. When the block is fully in its disconnecting position, the detent pawl 50 snaps into the upper detent notch 46 and the wire 32 can be extracted from the aperture 44.

While the preferred embodiments of the invention are described, it will be understood that the invention is in no way limited by these embodiments.

What is claimed is:

1. In a solderless connector for an insulated wire, having a body with an opening and a lever covering the opening and hingedly connected to the body and movable between an open position wherein the opening is uncoverd and a closed position wherein the opening is covered, the improvement comprising:

an electrical conductive terminal mounted in the body and having means slidably receptive of an insulated wire for electrically contacting the wire;

wire guide means having an aperture receptive of an insulated wire and slidably received in the opening in the body for movement between a disconnecting first position wherein the guide means is disposed partially outside of the body and wherein the wire can be inserted in the aperture and a connecting second position wherein the guide means is disposed in the body and the inserted wire is slidably received in the electrically connecting means of the terminal; and means operatively connecting the lever to the guide means to move the guide means from the disconnecting first position to the connecting second position in response to the movement of the lever from the open position to the closed position, and wherein the means connecting the lever to the guide means further includes means for moving the guide means from the connecting position to the disconnecting position in response to the movement of the lever from the closed position to the open position, whereby an inserted wire can be removed.

2. The connector according to claim 1, wherein the wire guiding means comprises an applicator block and wherein the body has means defining a straight line path for said block between the connecting and disconnecting positions.

3. The connector according to claim 2, wherein the block has an elongated slot at an innermost end of the block and extending parallel to the path for receiving the electrically contacting means and wherein said aperture extends through the block transverse to the path and intersecting said slot.

4. The connector according to claim 3, wherein the electrically contacting means comprises a pair of closely spaced resilient wire engaging fingers, wherein said terminal is affixed to the body with said fingers positioned within said elongated slot when the applicator block is in the connecting position.

5. The connector as recited in claim 3, wherein the operatively connecting means comprises a second elongated slot disposed in the applicator block at an end opposite said one ene and a pair member affixed to an intermediate portion of said lever and slidably receivable in the second slot.

6. The connector according to claim 3, wherein the body has a planar rear face and a plurality of side wall members projecting substantially perpendicular from one side of said rear face and defining an applicator compartment having a side opening, said opening having overlying means releasably connectable to said housing in a portion overlaying side wall members and disposed parallel to the rear face.

7. The connector as recited in claim 6, wherein said means defining a straight line path for the applicator block comprises parallel and spaced apart facing surfaces on said side wall members and wherein the applicator block includes parallel side edges, disposable between said facing surfaces of the side wall members.

8. The connector as recited in claim 7, further including detent means for releasably retaining said applicator block in the connecting and disconnecting positions respectively.

9. The connector as recited in claim 8, wherein said detent means includes a detent pawl resiliently affixed to one of said side edges of the applicator block and means defining a first notch configured to receive said pawl, said first notch positioned in the corresponding facing surface of said side wall wherein engagement of the pawl in said first notch occurs when said applicator block is in said disconnecting position, and further including means defining a second notch configured to receive the pawl, said second notch positioned in said corresponding facing surface wherein engagement of the pawl in the second notch occurs when said applicator block is in said connecting position.

10. The connector as recited in claim 9, wherein said overlying means includes a planar member disposable over said side walls and releasably retainable thereon and spaced apart from said one side of the rear face of the body, thereby confining the applicator block between said overlying means and said body.

11. The connector as recited in claim 10, wherein the planar member comprises the other side of the rear face of another body, thereby allowing a plurality of said connectors to be stacked in a parallel array.

* * * * *